US009914621B2

(12) United States Patent
Dominguez et al.

(10) Patent No.: US 9,914,621 B2
(45) Date of Patent: Mar. 13, 2018

(54) ELEVATOR SYSTEM WITH COUNTERWEIGHT

(71) Applicants: OTIS ELEVATOR COMPANY, Farmington, CT (US); Franck Dominguez, Loiret (FR)

(72) Inventors: Franck Dominguez, Loiret (FR); Nicolas Guillot, Coullons (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/037,508

(22) PCT Filed: Nov. 22, 2013

(86) PCT No.: PCT/IB2013/003088

§ 371 (c)(1),
(2) Date: May 18, 2016

(87) PCT Pub. No.: WO2015/075498

PCT Pub. Date: May 28, 2015

(65) Prior Publication Data

US 2016/0280513 A1 Sep. 29, 2016

(51) Int. Cl.
*B66B 7/04* (2006.01)
*B66B 17/12* (2006.01)
(Continued)

(52) U.S. Cl.
CPC ..... *B66B 7/047* (2013.01); *B66B 7/022* (2013.01); *B66B 7/024* (2013.01); *B66B 9/00* (2013.01); *B66B 17/12* (2013.01)

(58) Field of Classification Search
CPC ..... B66B 7/047; B66B 7/022; B66B 7/024; B66B 9/00; B66B 17/12
See application file for complete search history.

(56) References Cited

U.S. PATENT DOCUMENTS 1,814,610 A * 7/1931 Stevelman ..... B66B 7/048 16/93 R
1,837,643 A * 12/1931 Anderson ..... B66B 9/00 187/249

(Continued)

FOREIGN PATENT DOCUMENTS

CN 1109019 A 9/1995
CN 102753467 A 10/2012

(Continued)

OTHER PUBLICATIONS

International Search Report and Written Opinion of the International Searching Authority; Application No. PCT/IB2013/003088; dated Aug. 8, 2014; 12 pages.

(Continued)

*Primary Examiner* — Michael A Riegelman
(74) *Attorney, Agent, or Firm* — Cantor Colburn LLP

(57) ABSTRACT

A counterweight assembly for an elevator system includes a counterweight and a guide shoe affixed to the counterweight, the guide shoe extending continuously and unbroken along a vertical length of the counterweight. A counterweight guide system for an elevator system includes a plurality of first counterweight guide brackets secured in a hoistway at a first side of a counterweight and interactive with a first guide shoe affixed to the counterweight. A plurality of second counterweight guide brackets are secured in the hoistway at a second side of the counterweight opposite the first side and interactive with a second guide shoe affixed to the counterweight. Two or more first counterweight guide brackets are engaged with the first guide shoe during travel of the counterweight along the hoistway.

12 Claims, 3 Drawing Sheets

(51) Int. Cl.
*B66B 7/02* (2006.01)
*B66B 9/00* (2006.01)

(56) References Cited

U.S. PATENT DOCUMENTS 1,872,803 A * 8/1932 Persson ..... B66B 7/022 187/406
3,651,893 A * 3/1972 Berkovitz ..... B66B 1/42 187/254
3,948,358 A * 4/1976 Atkey ..... B66B 7/02 187/408
5,520,264 A 5/1996 Korhonen
5,625,174 A * 4/1997 Ito ..... B66B 11/0055 187/250
6,012,554 A * 1/2000 Ito ..... B66B 7/022 187/406
2006/0260878 A1* 11/2006 Hashiguchi ..... B66B 11/0226 187/249
2012/0318618 A1* 12/2012 Ruiz ..... B66B 7/047 187/406
2015/0291396 A1* 10/2015 Nakamura ..... B66B 17/12 187/404
2017/0008733 A1* 1/2017 Fernandez ..... B66B 7/022

FOREIGN PATENT DOCUMENTS

JP 54162350 A 12/1979
JP 0318581 A 1/1991
JP 2005206361 A 8/2005
JP 2006082934 A 3/2006
JP 2006151578 A 6/2006
JP 2012144363 A 8/2012
KR 2019880001450 Y1 4/1988
WO 2011076532 A1 6/2011

OTHER PUBLICATIONS

European Search Report issued in EP Application No. 1389726.5, dated Jul. 13, 2017, 9 Pages.

* cited by examiner

ELEVATOR SYSTEM WITH COUNTERWEIGHT

BACKGROUND

The subject matter disclosed herein generally relates to elevator systems. More specifically, the subject disclosure relates to guides for counterweights of elevator systems.

Elevator systems typically include an elevator car suspended in a hoistway by a number of suspension ropes or belts, and a counterweight suspended by the ropes or belts to balance the elevator system. The counterweight and elevator car each are guided by guide rails fixed in the hoistway, and extend continuously for an entire length of the travel path of the counterweight and elevator.

The elevator car is connected to the car guide rails via one or more car guide shoes such that the elevator car follows a path defined by the car guide rails as it moves through the hoistway. Similarly, the counterweight includes one or more counterweight guide shoes to guide the counterweight along a path defined by the counterweight guide rails.

The counterweight guide rails, however, are typically heavy and cumbersome to install in the hoistway. Further, the counterweight guide rails use high volumes of material due to their continuous length along the hoistway. Both of these factors make manufacture and installation of the counterweight guide rails costly and time consuming.

BRIEF DESCRIPTION

In one embodiment, a counterweight assembly for an elevator system includes a counterweight and a guide shoe affixed to the counterweight, the guide shoe extending continuously and unbroken along a vertical length of the counterweight.

In this or other embodiments, the guide shoe is affixed to a counterweight frame.

In this or other embodiments, the guide shoe has a u-shaped cross-section.

In this or other embodiments, the guide shoe is formed from a sheet metal material.

In this or other embodiments, the guide shoe is two guide shoes disposed at opposing sides of the counterweight.

In another embodiment, a counterweight guide system for an elevator system includes a plurality of first counterweight guide brackets secured in a hoistway at a first side of a counterweight and interactive with a first guide shoe affixed to the counterweight. A plurality of second counterweight guide brackets are secured in the hoistway at a second side of the counterweight opposite the first side and interactive with a second guide shoe affixed to the counterweight. Two or more first counterweight guide brackets are engaged with the first guide shoe during travel of the counterweight along the hoistway.

In this or other embodiments, each first counterweight guide bracket is connected to a second counterweight guide bracket by a support extending from the first counterweight guide bracket to the second counterweight guide bracket.

In this or other embodiments, the first counterweight guide brackets and/or the second counterweight brackets are formed from sheet metal.

In yet another embodiment, an elevator system includes an elevator car positioned in a hoistway, and a counterweight positioned in the hoistway and operably connected to the elevator car. A counterweight guide system includes a plurality of first counterweight guide brackets secured in the hoistway at a first side of the counterweight and interactive with a first guide shoe affixed to the counterweight. A plurality of second counterweight guide brackets are secured in the hoistway at a second side of the counterweight opposite the first side and interactive with a second guide shoe affixed to the counterweight. Two or more first counterweight guide brackets are engaged with the first guide shoe during travel of the counterweight along the hoistway.

In this or other embodiments, the first guide shoe and/or the second guide shoe is affixed to a counterweight frame.

In this or other embodiments, the first guide shoe and/or the second guide shoe has a u-shaped cross-section.

In this or other embodiments, the first guide shoe and/or the second guide shoe is formed from a sheet metal material.

In this or other embodiments, each first counterweight guide bracket is connected to a second counterweight guide bracket by a support extending from the first counterweight guide bracket to the second counterweight guide bracket.

In this or other embodiments, the first counterweight guide brackets and/or the second counterweight brackets are formed from sheet metal.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
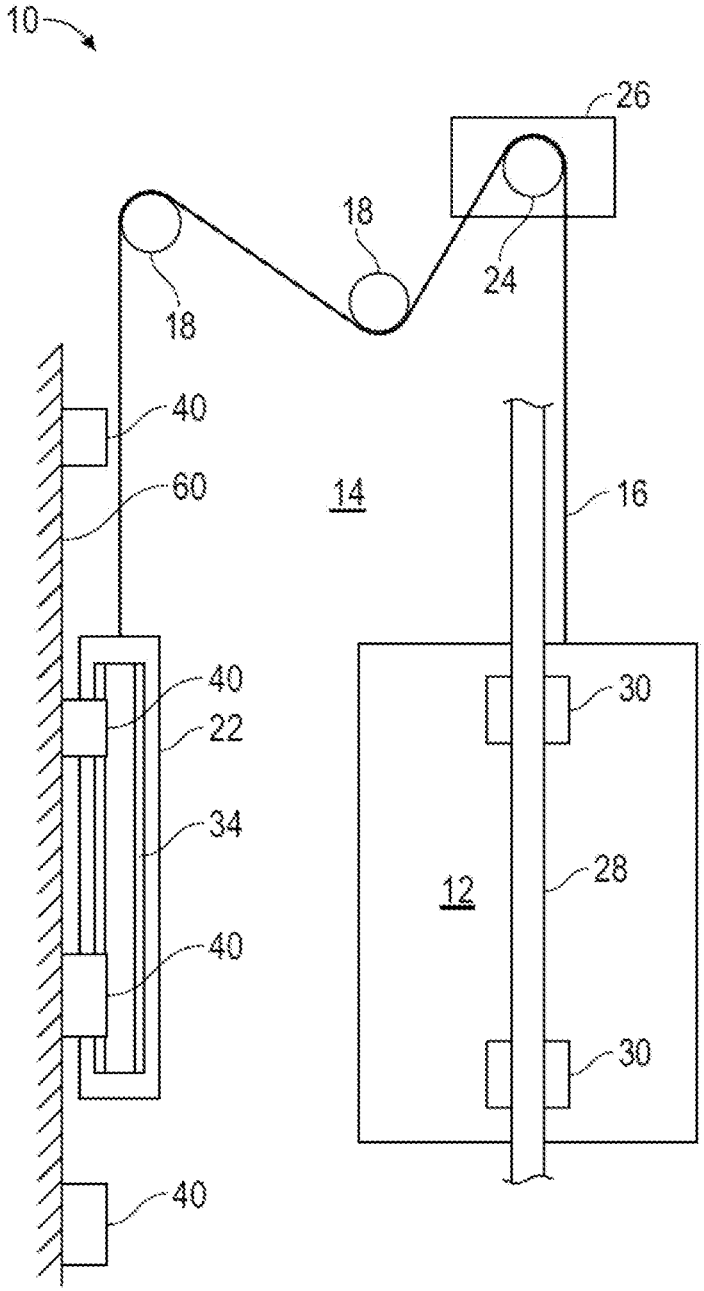
FIG. 1 is a schematic view of an embodiment of an elevator system.

Shown in FIG. 1 is a schematic of an exemplary traction elevator system 10. Features of the elevator system 10 that are not required for an understanding of the present invention are not discussed herein. The elevator system 10 includes an elevator car 12 operatively suspended or supported in a hoistway 14 with one or more drive members 16, such as ropes or belts. The drive members 16 interact with one or more sheaves 18 to be routed around various components of the elevator system 10. One of the sheaves may be a traction sheave 24 driven by a machine 26 to raise and lower the elevator car 12 in the hoistway 14. The drive members 16 are also be connected to a counterweight 22, which is used to help balance the elevator system 10 and reduce the difference in belt tension on both sides of the traction sheave during operation.

To guide movement of the elevator car 12 along the hoistway 14, one or more car guide rails 28 are fixed in the hoistway 14. The car guide rails 28 define a travel path for the elevator car 12 in the hoistway 14 and may be utilized in conjunction with other components, such as elevator safety brakes (not shown) to stop movement of the elevator car 12. The elevator car 12 includes one or more car guide shoes 30, in some embodiments two car guide shoes 30 at each car guide rail 28, which interface with the car guide rail 28.

Figure 2:
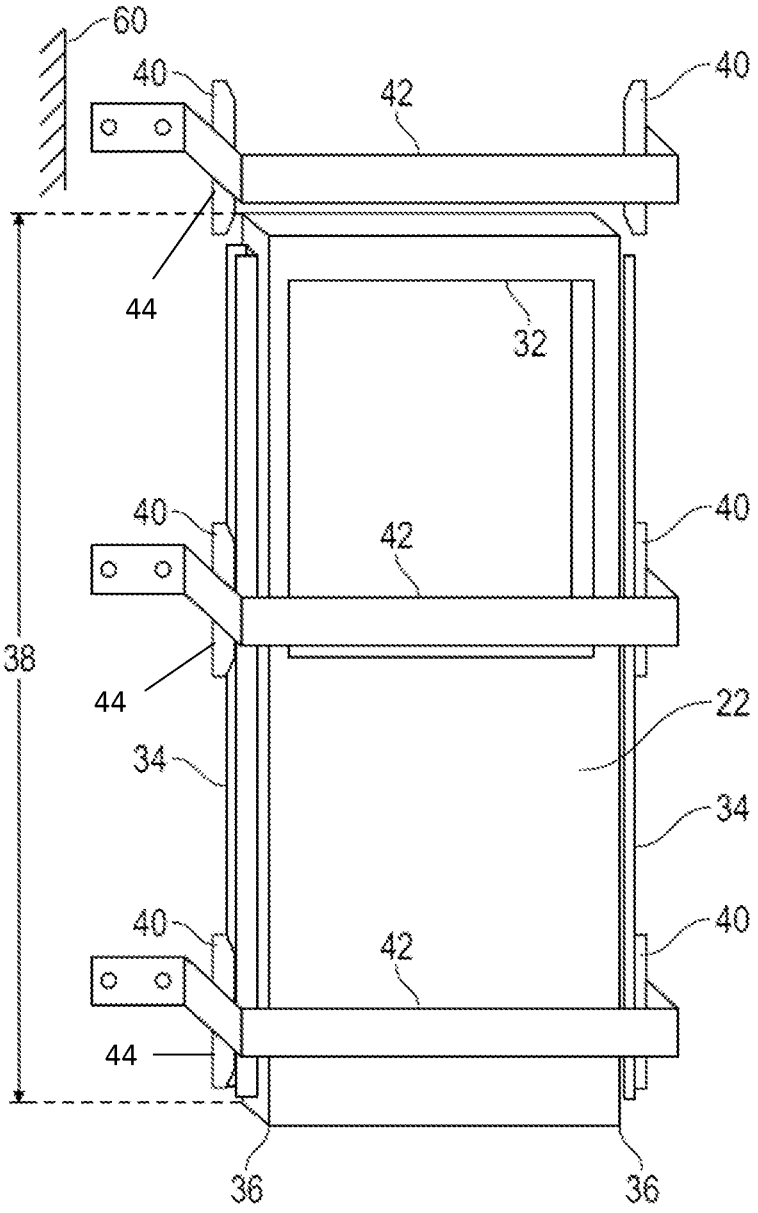
FIG. 2 is a schematic view of an embodiment of a guide arrangement for a counterweight of an elevator system.

Referring to FIG. 2, the counterweight 22 includes a counterweight frame 32 extending around the counterweight 22. A counterweight shoe 34 is affixed to the counterweight frame 32 at each lateral side 36 of the counterweight 22 and extends continuously along a vertical length 38 of the counterweight 22. In some embodiments, the counterweight shoe 34 extends along the entire vertical length 38 of the counterweight frame 32 to maximize The counterweight shoe 34 interacts with a series of counterweight guide brackets 40 affixed in the hoistway 14, for example, affixed to a hoistway wall 60, to define the travel path of the counterweight 22. In some embodiments, guide brackets 40 are positioned at each lateral side 36 of the counterweight 22 in pairs, and are connected via a support 42 extending across the counterweight between guide brackets 40 of each pair. The support 42 aids in limiting movement and/or deflection of the guide brackets 40 during operation of the elevator system 10. The guide brackets 40 and the support may be formed from sheet metal materials, which reduces weight of the brackets and support compared to other materials and therefore improves ease of installation in the hoistway 14. The guide brackets 40 are spaced along the hoistway 14 such that at least two guide brackets 40 are engaged with each counterweight shoe 34 at any time in the counterweight's travel along the hoistway 14. In some embodiments, the counterweight shoe 34 extends along the entire vertical length 38 of the counterweight frame 32 to maximize the spacing between adjacent guide brackets 40. In some embodiments, a vertical position of opposing guide brackets 40 of each pair may be staggered.

Figure 3:
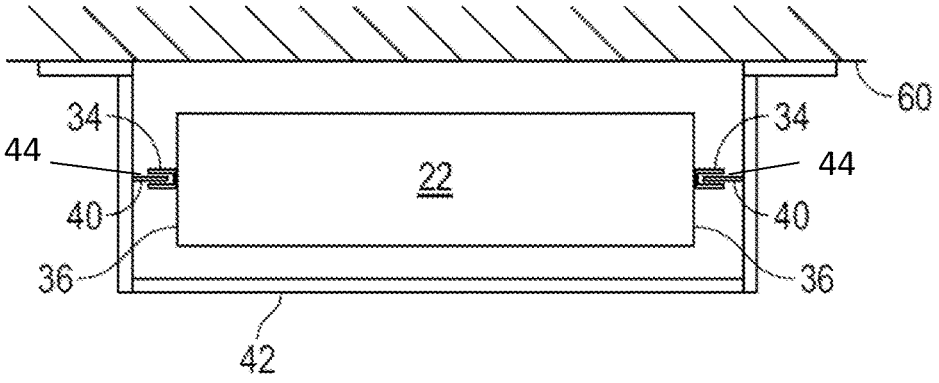
FIG. 3 is a cross-sectional view of an embodiment of a guide arrangement for a counterweight of an elevator system.

Referring now to FIG. 3, the guide brackets 40 are secured to the hoistway wall 60. The counterweight shoe 34 has a U-shaped cross-section such that a blade 44 of the guide bracket 40 is inserted into the cross-section to engage the counterweight shoe 34 with the guide bracket 40. In some embodiments, the counterweight shoe 34, like the guide bracket 40 is formed from a sheet metal material to reduce weight of the counterweight shoe 34 while maintaining a necessary structural rigidity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A counterweight assembly for an elevator system comprising:

a counterweight;

a guide shoe affixed to the counterweight, the guide shoe extending continuously and unbroken along a vertical length of the counterweight;

a plurality of guide brackets affixed to a hoistway wall for engaging the guide shoe, the plurality of guide brackets spaced vertically from each other; and a support to connect a first counterweight guide bracket located at a first side of the counterweight to a second counterweight guide bracket at a second side of the counterweight, opposite the first side.

2. The counterweight assembly of claim 1, wherein the guide shoe is affixed to a counterweight frame.

3. The counterweight assembly of claim 1, wherein the guide shoe has a u-shaped cross-section.

4. The counterweight assembly of claim 1, wherein the guide shoe is formed from a sheet metal material.

5. The counterweight assembly of claim 1, wherein the guide shoe is two guide shoes disposed at opposing sides of the counterweight.

6. A counterweight guide system for an elevator system comprising:

a plurality of first counterweight guide brackets secured in a hoistway at a first side of a counterweight and interactive with a first guide shoe affixed to the counterweight; and a plurality of second counterweight guide brackets secured in the hoistway at a second side of the counterweight opposite the first side and interactive with a second guide shoe affixed to the counterweight;

wherein two or more first counterweight guide brackets are engaged with the first guide shoe during travel of the counterweight along the hoistway; and wherein each first counterweight guide bracket is connected to a second counterweight guide bracket by a support extending from the first counterweight guide bracket to the second counterweight guide bracket.

7. The counterweight guide system of claim 6, wherein the first counterweight guide brackets and/or the second counterweight brackets are formed from sheet metal.

8. An elevator system comprising:

an elevator car disposed in a hoistway;

a counterweight disposed in the hoistway and operably connected to the elevator car; and a counterweight guide system comprising:

a plurality of first counterweight guide brackets secured in the hoistway at a first side of the counterweight and interactive with a first guide shoe affixed to the counterweight; and a plurality of second counterweight guide brackets secured in the hoistway at a second side of the counterweight opposite the first side and interactive with a second guide shoe affixed to the counterweight;

wherein two or more first counterweight guide brackets are engaged with the first guide shoe during travel of the counterweight along the hoistway; and wherein each first counterweight guide bracket is connected to a second counterweight guide bracket by a support extending from the first counterweight guide bracket to the second counterweight guide bracket.

9. The elevator system of claim 8, wherein the first guide shoe and/or the second guide shoe is affixed to a counterweight frame.

10. The elevator system of claim 8, wherein the first guide shoe and/or the second guide shoe has a u-shaped cross-section.

11. The elevator system of claim 8, wherein the first guide shoe and/or the second guide shoe is formed from a sheet metal material.

12. The elevator system of claim 8, wherein the first counterweight guide brackets and/or the second counterweight brackets are formed from sheet metal.

* * * * *